US008869979B2

(12) United States Patent
Smalley

(10) Patent No.: US 8,869,979 B2
(45) Date of Patent: Oct. 28, 2014

(54) CARRIER FOR CONTAINERS

(75) Inventor: Brian Smalley, Bristol (GB)

(73) Assignee: Graphic Packaging International, Inc., Atlanta, GA (US)

( * ) Notice: Subject to any disclaimer, the term of this patent is extended or adjusted under 35 U.S.C. 154(b) by 281 days.

(21) Appl. No.: 12/897,201

(22) Filed: Oct. 4, 2010

(65) Prior Publication Data

US 2011/0083976 A1 Apr. 14, 2011

Related U.S. Application Data

(60) Provisional application No. 61/278,322, filed on Oct. 5, 2009.

(51) Int. Cl.
*B65D 75/00* (2006.01)
*B65D 71/64* (2006.01)

(52) U.S. Cl.
CPC .... *B65D 71/0055* (2013.01); *B65D 2571/0066* (2013.01); *B65D 2571/00858* (2013.01); *B65D 2571/0029* (2013.01); *B65D 2571/00728* (2013.01); *B65D 2571/00574* (2013.01); *B65D 2571/00141* (2013.01); *B65D 2571/00475* (2013.01)
USPC ..... 206/148; 206/149; 206/175; 206/427

(58) Field of Classification Search
USPC ..... 206/141–149, 153, 156, 170, 174, 175, 206/194, 197, 199, 200, 427, 431; 229/87.4, 117.14, 131.1; 493/121, 162; 53/398, 467, 473
See application file for complete search history.

(56) References Cited

U.S. PATENT DOCUMENTS

| | | | | |
|---|---|---|---|---|
| 1,968,877 | A | 8/1934 | Cubberly | |
| 2,200,813 | A * | 5/1940 | Warren | 206/143 |
| 2,225,822 | A | 12/1940 | Crook | |
| 2,227,330 | A | 12/1940 | Turner | |
| 2,331,312 | A | 10/1943 | Dorfman | |
| 2,336,857 | A | 12/1943 | Gies et al. | |
| 2,340,230 | A * | 1/1944 | Slevin, Jr. | 206/171 |

(Continued)

FOREIGN PATENT DOCUMENTS

| | | |
|---|---|---|
| CN | 1293638 A | 5/2001 |
| DE | 90 04 439 U1 | 6/1990 |

(Continued)

OTHER PUBLICATIONS

Argentina Model No. 78777, Dec. 29, 2008, Overprint S.R.L.

(Continued)

*Primary Examiner* — Luan K Bui
(74) *Attorney, Agent, or Firm* — Womble Carlyle Sandridge & Rice, LLP

(57) ABSTRACT

A carrier for holding a plurality of containers. The carrier comprises panels that extend at least partially around an interior of the carrier. The panels comprise at least one bottom panel, at least one top panel, a front panel, a back panel, and at least two side panels. The at least one top panel is foldably connected to one of the front panel and the back panel. The at least one top panel has a handle portion for forming a handle of the carrier and a retaining portion having container receiving openings for receiving the containers in the carrier. The carrier includes a reinforcement flap adjacent at least one of the container receiving openings for contacting at least one of the plurality of containers.

14 Claims, 6 Drawing Sheets

(56) References Cited

U.S. PATENT DOCUMENTS

| | | | | | |
|---|---|---|---|---|---|
| 2,345,565 | A | * | 4/1944 | Arneson | 206/175 |
| 2,417,421 | A | | 3/1947 | Koolnis | |
| 2,522,950 | A | | 9/1950 | Keith | |
| 2,529,675 | A | | 11/1950 | Brulin | |
| 2,563,065 | A | * | 8/1951 | Price | 206/171 |
| 2,689,061 | A | | 9/1954 | Gray | |
| 2,783,916 | A | | 3/1957 | Hodapp | |
| 2,804,234 | A | | 8/1957 | Lachance | |
| 3,053,411 | A | | 9/1962 | Struble et al. | |
| 3,140,036 | A | | 7/1964 | Spery | |
| 3,190,487 | A | | 6/1965 | Wood | |
| 3,191,800 | A | | 6/1965 | Kowal | |
| 3,229,849 | A | | 1/1966 | Spillson | |
| 3,236,414 | A | | 2/1966 | Slevin, Jr. | |
| 3,355,012 | A | | 11/1967 | Weiss | |
| 3,386,570 | A | | 6/1968 | Lock | |
| 3,493,261 | A | | 2/1970 | Funkhouser et al. | |
| 3,669,306 | A | | 6/1972 | Forrer | |
| 3,670,950 | A | | 6/1972 | Rossi | |
| 3,684,153 | A | | 8/1972 | Detzel | |
| 3,744,704 | A | | 7/1973 | Struble | |
| 3,780,906 | A | * | 12/1973 | Katzenmeyer | 206/170 |
| 3,814,238 | A | | 6/1974 | Wood | |
| 3,820,657 | A | | 6/1974 | Klygis et al. | |
| 3,917,061 | A | | 11/1975 | Stout | |
| 4,101,069 | A | | 7/1978 | Wood | |
| 4,146,168 | A | | 3/1979 | Hartline | |
| 4,171,046 | A | | 10/1979 | Bonczyk | |
| 4,205,748 | A | | 6/1980 | Wilson | |
| 4,243,138 | A | | 1/1981 | Wilson | |
| 4,250,992 | A | | 2/1981 | Gilbert | |
| 4,308,950 | A | | 1/1982 | Wood | |
| 4,319,682 | A | | 3/1982 | Wright et al. | |
| 4,362,240 | A | | 12/1982 | Elward | |
| 4,374,561 | A | | 2/1983 | Stout et al. | |
| 4,406,365 | A | | 9/1983 | Kulig | |
| 4,413,729 | A | | 11/1983 | Wood | |
| 4,424,901 | A | | 1/1984 | Lanier | |
| 4,450,956 | A | | 5/1984 | Wood | |
| 4,470,503 | A | | 9/1984 | Stone | |
| 4,480,746 | A | | 11/1984 | Wood | |
| 4,645,072 | A | | 2/1987 | Lemon | |
| 4,708,284 | A | | 11/1987 | Sutherland et al. | |
| 4,722,437 | A | | 2/1988 | Walsh | |
| 4,792,038 | A | | 12/1988 | Cooper | |
| 4,927,009 | A | | 5/1990 | Stout | |
| 5,040,672 | A | | 8/1991 | DeMaio et al. | |
| 5,167,325 | A | | 12/1992 | Sykora | |
| 5,400,901 | A | | 3/1995 | Harrelson | |
| 5,458,234 | A | | 10/1995 | Harris | |
| 5,499,712 | A | | 3/1996 | Harrelson | |
| 5,518,110 | A | | 5/1996 | Harrelson | |
| 5,531,319 | A | | 7/1996 | Harrelson | |
| 5,538,130 | A | | 7/1996 | Harrelson | |
| 5,538,131 | A | | 7/1996 | Harrelson | |
| 5,590,762 | A | | 1/1997 | Harrelson | |
| 5,593,027 | A | | 1/1997 | Sutherland | |
| 5,595,291 | A | | 1/1997 | Negelen | |
| 5,624,024 | A | | 4/1997 | Miess | |
| 5,645,162 | A | | 7/1997 | Harrelson | |
| 5,649,620 | A | | 7/1997 | Harrelson | |
| 5,657,864 | A | | 8/1997 | Harrelson | |
| 5,657,865 | A | | 8/1997 | Harrelson | |
| 5,682,982 | A | | 11/1997 | Stonehouse | |
| 5,695,051 | A | | 12/1997 | Hart | |
| 5,709,298 | A | | 1/1998 | Harris | |
| 5,775,487 | A | | 7/1998 | Harrelson | |
| 5,803,264 | A | * | 9/1998 | Gersten et al. | 206/549 |
| 5,871,090 | A | | 2/1999 | Doucette et al. | |
| 5,878,877 | A | | 3/1999 | Sutherland | |
| 5,947,273 | A | | 9/1999 | Dalrymple et al. | |
| 6,131,729 | A | | 10/2000 | Eckermann et al. | |
| 6,155,962 | A | | 12/2000 | Dalrymple et al. | |
| 6,168,013 | B1 | | 1/2001 | Gomes | |
| 6,341,689 | B1 | | 1/2002 | Jones | |
| 6,371,287 | B1 | | 4/2002 | Jones et al. | |
| 6,488,322 | B2 | * | 12/2002 | Bakx | 294/87.2 |
| 6,527,108 | B1 | * | 3/2003 | Blin et al. | 206/148 |
| 6,571,941 | B2 | | 6/2003 | Holley, Jr. | |
| 6,695,137 | B2 | | 2/2004 | Jones et al. | |
| 6,736,260 | B2 | * | 5/2004 | Gomes et al. | 206/175 |
| D505,336 | S | | 5/2005 | Schuster | |
| 6,896,130 | B2 | | 5/2005 | Theelen | |
| 6,938,756 | B2 | | 9/2005 | Schuster | |
| 7,011,209 | B2 | | 3/2006 | Sutherland et al. | |
| 7,070,045 | B2 | | 7/2006 | Theelen | |
| 7,128,206 | B2 | | 10/2006 | Kohler | |
| 7,207,934 | B2 | | 4/2007 | Schuster | |
| 7,374,038 | B2 | | 5/2008 | Smalley | |
| 7,677,387 | B2 | | 3/2010 | Brand et al. | |
| 7,793,780 | B2 | | 9/2010 | Smalley | |
| 8,091,702 | B1 | * | 1/2012 | Keip | 206/171 |
| 2003/0111363 | A1 | | 6/2003 | Theelen | |
| 2003/0159950 | A1 | | 8/2003 | Jones et al. | |
| 2003/0213705 | A1 | | 11/2003 | Woog | |
| 2004/0026269 | A1 | | 2/2004 | Cuomo | |
| 2005/0199513 | A1 | * | 9/2005 | Bakx et al. | 206/139 |
| 2005/0230273 | A1 | | 10/2005 | Kohler | |
| 2006/0091024 | A1 | | 5/2006 | Cuomo | |
| 2006/0148629 | A1 | | 7/2006 | Cuomo | |
| 2007/0295623 | A1 | * | 12/2007 | Brand et al. | 206/193 |
| 2009/0008273 | A1 | | 1/2009 | Smalley | |
| 2010/0006458 | A1 | | 1/2010 | Wilkins et al. | |
| 2010/0072086 | A1 | | 3/2010 | Smalley | |
| 2010/0147932 | A1 | | 6/2010 | Brand | |

FOREIGN PATENT DOCUMENTS

| | | | |
|---|---|---|---|
| EP | 0 452 563 | A1 | 10/1991 |
| EP | 1 319 607 | A1 | 6/2003 |
| EP | 1 348 638 | A1 | 10/2003 |
| GB | 2 279 065 | A | 12/1994 |
| JP | 2003-300554 | A | 10/2003 |
| WO | WO 97/05026 | | 2/1997 |
| WO | WO 98/31601 | A1 | 7/1998 |
| WO | WO 00/37331 | | 6/2000 |

OTHER PUBLICATIONS

International Search Report and Written Opinion dated Jun. 28, 2011 for PCT/US2010/051270.

Supplementary European Search Report for EP 10 82 2468 dated Feb. 26, 2013.

Notification of the First Office Action and Search Report for CN 201080044626.2 dated Jun. 3, 2013, with translation.

* cited by examiner

CARRIER FOR CONTAINERS

CROSS-REFERENCE TO RELATED APPLICATION

This application claims the benefit of U.S. Provisional Application No. 61/278,322, filed Oct. 5, 2009.

INCORPORATION BY REFERENCE

The entire disclosure of U.S. Patent Application 61/278,322, filed Oct. 5, 2009 is incorporated herein in its entirety by this reference.

BACKGROUND OF THE DISCLOSURE

The present disclosure generally relates to carriers or cartons for holding and optionally also displaying containers.

SUMMARY OF SOME ASPECTS OF THE DISCLOSURE

In accordance with one aspect of this disclosure, a construct (e.g., a blank, carton, or the like) has a plurality of panels that are respectively foldably connected to one another. A reinforcement flap is positioned in an opening defined by at least one of the panels. The reinforcement flap is pivotably connected to at least one edge of the opening by first and second connections (e.g., nicks), so that the reinforcement flap is pivotable about a pivot axis. The pivot axis is cooperatively defined by the first and second connections. The pivot axis extends in an axial direction across the opening, and the first and second connections are spaced apart from one another in the axial direction. The reinforcement flap includes opposite inner and outer edges that are spaced apart from one another in a lateral direction that extends crosswise to the axial direction, so that the pivot axis is positioned between the inner and outer edges of the reinforcement flap. The reinforcement flap may be pivoted between first and second configurations by inserting an object, such as, but not limited to, the neck of a bottle, into the opening. In the first configuration, the reinforcement flap may be substantially coplanar with the at least one panel in which the opening is defined. In the second configuration, the neck of the bottle may extend through the opening and be engaged to the reinforcement flap, the inner edge of the reinforcement flap may be positioned below the at least one edge of the opening, and the outer edge of the reinforcement flap may be positioned above the at least one edge of the opening.

One aspect of the disclosure is directed to a carrier for holding a plurality of containers. The carrier comprises panels that extend at least partially around an interior of the carrier. The panels comprise at least one bottom panel, at least one top panel, a front panel, a back panel, and at least two side panels. The at least one top panel is foldably connected to one of the front panel and the back panel. The at least one top panel has a handle portion for forming a handle of the carrier and a retaining portion having container receiving openings for receiving the containers in the carrier. The carrier includes a reinforcement flap adjacent at least one of the container receiving openings for contacting a neck of at least one of the plurality of containers. The reinforcement flap may protect a foil cover on the neck of the container, guide the neck of the container, and/or protect the edge of the container receiving opening. As a result, the carrier may be made from a material having a reduced thickness (e.g., paperboard having a lower board caliper).

In another aspect, the disclosure is generally directed to a blank for forming a carrier. The blank comprises a front panel, a back panel, a first side panel foldably connected to at least one of the front panel and the back panel, a second side panel foldably connected to at least one of the front panel and the back panel, at least one top panel, and at least one bottom panel. The at least one top panel is foldably connected to one of the front panel and the back panel. The at least one top panel comprises a handle portion for forming a handle of the carrier formed from the blank, and a retaining portion having container receiving openings. The at least one top panel comprises at least one reinforcement flap foldably connected to the retaining portion and positioned adjacent a respective container receiving opening.

Those skilled in the art will appreciate the above stated advantages and other advantages and benefits of various additional embodiments reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION

The present disclosure generally relates to carriers, packages, constructs, sleeves, cartons, or the like, for holding and optionally also displaying containers such as jars, bottles, cans, etc. The containers can be used for packaging food and beverage products, for example. The containers can be made from materials suitable in composition for packaging the particular food or beverage item, and the materials include, but are not limited to, plastics such as PET, LDPE, LLDPE, HDPE, PP, PS, PVC, EVOH, and Nylon; and the like; aluminum and/or other metals; glass; or any combination thereof.

Carriers according to the present disclosure can accommodate containers of numerous different shapes. For the purpose of illustration and not for the purpose of limiting the scope of the disclosure, the following detailed description describes beverage containers (e.g., glass bottles or plastic containers) at least partially disposed within the carrier embodiments. In this specification, the terms "lower," "bottom," "upper", "top", "front", and "back" indicate orientations determined in relation to fully erected carriers.

Figure 1:
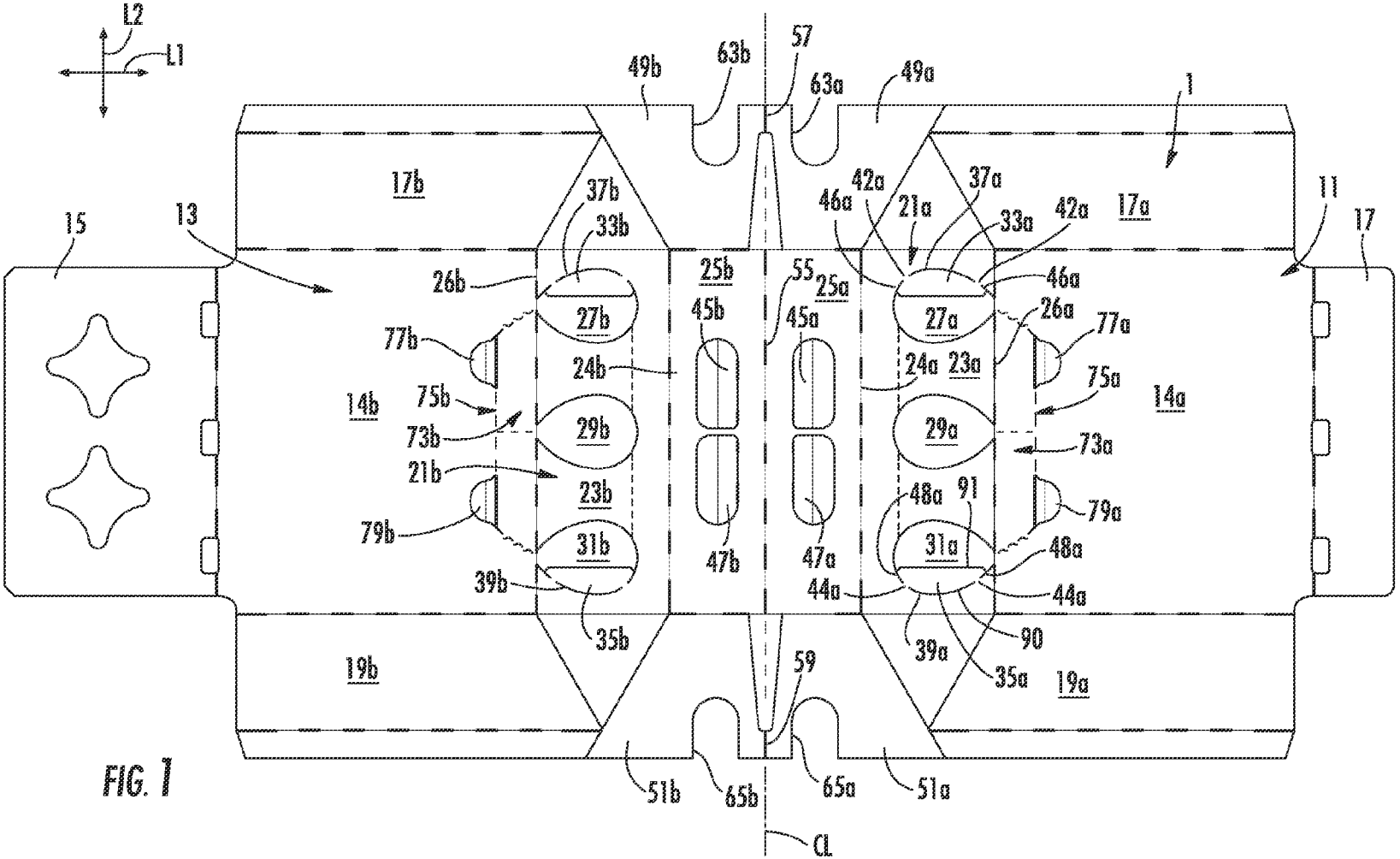
FIG. 1 is a plan view of an exterior surface of a blank used to form a carrier according to one embodiment of the disclosure.

FIG. 1 is a plan view of an exterior side 1 of a blank 3 used to form a package or basket-style carrier 5 (FIG. 2-6), in accordance with an exemplary embodiment of the present disclosure. As shown in FIGS. 2-6, the carrier 5 is sized to contain six containers C, three containers being contained in a front portion 7 of the carrier and three containers being contained in a back portion 9 of the carrier. The carrier 5 may be sized and shaped to hold more or less than six containers. In the illustrated embodiment, the containers C are beverage bottles with necks covered by a foil cover 6, or the like, that extends upwardly to just below the caps of the containers, but the containers could be any other suitable type and size of container without departing from the disclosure. As will be discussed in greater detail below, portions of the carrier 5 are cut away in FIGS. 2-4 to show a portion of the interior of the carrier.

The blank 3 has a longitudinal axis L1 and a lateral axis L2. The blank 3 has a first portion 11 for forming the front portion 7 of the carrier 5, and a second portion 13 for forming the back portion 9 of the carrier. A bottom panel 15 is foldably connected by a fold line to the second portion 13, and a bottom adhesive flap 17 is foldably connected by a fold line to the first portion 11. In the illustrated embodiment, the first portion 11 and second portion 13 are for being folded about a lateral centerline CL when the blank 3 is formed into the carrier 5. As discussed in more detail below, the blank 3 is formed into the carrier 5 by folding the blank about the centerline CL so that the first portion 11 and the second portion 13 are overlapped.

In the illustrated embodiment, the first portion 11 is generally a mirror image of the second portion 13. Accordingly, like or similar features of the first portion 11 and the second portion 13 are given like or similar reference numbers with the features of the first portion given the suffix "a", and the features of the second portion 13 given the suffix "b". Also, a discussion of one of two similar features is generally applicable to the other of the similar features.

The first portion 11 has a front panel 14*a* foldably connected by respective fold lines to a first side panel 17*a* and a second side panel 19*a*. As will be discussed in greater detail below, an outer marginal portion of each of the side panels 17*a*, 19*a* is connected by a fold line to the main portion of the respective side panel 17*a*, 19*a* and serves as a glue flap. The first portion 11 includes a top panel 21*a* foldably connected to the front panel 14*a* at a lateral fold line 26*a*. The top panel 21*a* includes a retention portion 23*a* that is foldably connected to a handle portion 25*a* at a lateral fold line 24*a*. The retention portion 23*a* is foldably connected to the front panel 14*a* at the lateral fold line 26*a* and has three openings 27*a*, 29*a*, 31*a*.

The two outer openings 27*a*, 31*a* are at least partially respectively defined by reinforcement flaps 33*a*, 35*a* that are adjacent the openings. The reinforcement flaps 33*a*, 35*a* may also be characterized as respectively extending into the outer openings 27*a*, 31*a*. Initially, the reinforcement flaps 33*a*, 35*a* are coplanar with the retention portion 23*a* of the top panel 21*a*. In the illustrated embodiment, the reinforcement flaps 33*a*, 35*a* are respectively at least partially defined by a respective curved cut 37*a*, 39*a* (e.g., slit) in the retention portion 23*a*. The reinforcement flaps 33*a*, 35*a* are foldably connected to the retention portion 23*a* by respective connectors that may be characterized as nicks 42*a*, 44*a*. The nicks 42*a*, 44*a* are located at respective ends of the curved cuts 37*a*, 39*a*. The nicks 42*a*, 44*a* are areas of material in the retention portion 23*a* that are typically free from cuts, and at least initially they are free of fold lines or other lines of weakness. The nicks 42*a*, 44*a* are adjacent respective curved cuts 46*a*, 48*a* (e.g., slits) that extend from a respective one of the nicks to a respective opening 27*a*, 31*a*. In accordance with the illustrated embodiment and for example, a continuous slit would be collectively formed by the cuts 37*a*, 46*a*, except that that continuous slit is interrupted by the nicks 46*a*. The openings 27*a*, 29*a*, 31*a* and the reinforcement flaps 33*a*, 35*a* could be otherwise shaped, arranged, and/or configured without departing from the disclosure.

The handle portion 25*a* optionally includes two handle flaps 45*a*, 47*a* that are foldably connected to the handle portion and partially obstruct handle holes in the handle portion. The handle portion 25*a* optionally also includes two handle reinforcement flaps 49*a*, 51*a* foldably connected by fold lines to the handle portion at respective ends of the top panel 21*a*. The handle portion 25*a* of the first portion 11 is foldably connected to the handle portion 25*b* of the second portion 13 at a lateral fold line 55. The handle reinforcement flaps 49*a*, 51*a* of the first portion 11 are foldably connected to the respective handle reinforcement flaps 49*b*, 51*b* of the second portion 13 at respective lateral fold lines 57, 59. The handle reinforcement flaps 49*a*, 51*a* have respective notches 63*a*, 65*a* that cooperate with the handle holes partially obstructed by the handle flaps 45*a*, 47*a* to form a handle of the carrier 5. The handle reinforcement flaps 49*a*, 49*b*, 51*a*, 51*b* are respectively separated from the adjacent side panels 17*a*, 17*b*, 19*a*, 19*b* by slits and cut-outs. The handle could be formed by other features of the blank 3 without departing from the disclosure.

In the illustrated embodiment the front panel 14*a* has a dispenser panel 73*a* formed from a series of tear lines 75*a* in the front panel. The series of tear lines 75*a* includes portions that respectively extend from each opening 27*a*, 29*a*, 31*a*. The dispenser panel 73*a* has tabs 77*a*, 79*a* in the front panel 14*a* for grasping and initiating tearing of respective portions of the series of tear lines 75*a*. When the dispenser panel 73*a* of the carrier 5 is at least partially separated from the front panel 14*a* (e.g., see FIG. 5), the containers C can be accessed and removed from the carrier. The dispenser panel 73*a* could be otherwise shaped, arranged, configured, and/or omitted without departing from the disclosure.

In one exemplary method of erection of the carrier 5, the handle reinforcement flaps 49*a*, 49*b*, 51*a*, 51*b* are folded inwardly relative to a respective top panel 21*a*, 21*b* so that the reinforcement flaps overlap and are in face-to-face contact with a respective top panel. Similarly, the side panels 17*a*, 17*b*, 19*a*, 19*b* are folded inwardly relative to a respective front panel 14*a* and back panel 14*b* so that the side panels overlap and are in face-to-face contact with a respective front or back panel. Then, adhesive material is applied to the upper surfaces of each of the handle reinforcement flaps 49*a*, 49*b*, 51*a*, 51*b* and the glue flap portions of the side panels 17*a*, 17*b*, 19*a*, 19*b*. Then the partially erected blank is folded about one hundred and eighty degrees at fold lines 55, 57, 59 so that the glue flaps of the side panels 17*a*, 17*b* are attached to each other, the glue flaps of the side panels 19*a*, 19*b* are attached to each other, and the handle reinforcement flaps 49*a*, 49*b*, 51*a*, 51*c* are respectively attached to each other.

Figure 2:
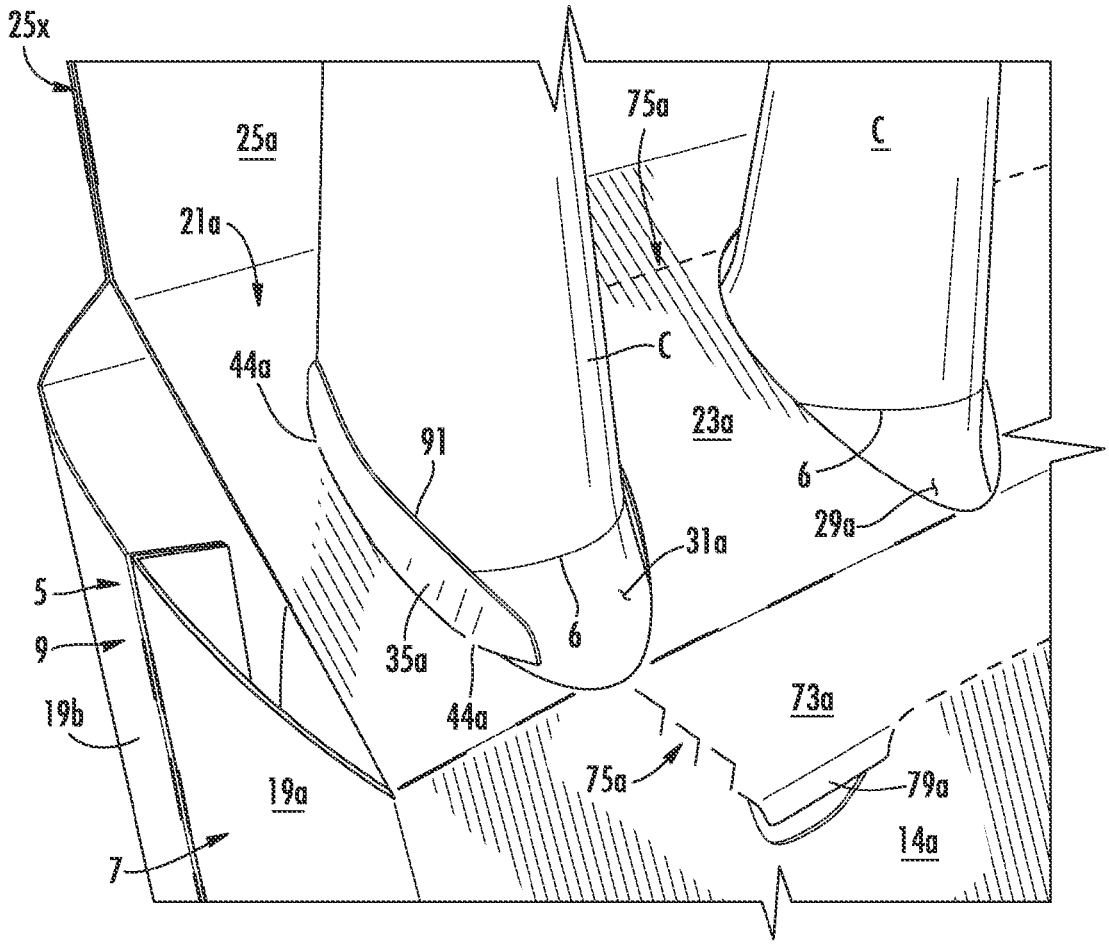
FIG. 2 is a perspective view of a portion of a carrier erected from the blank of FIG. 1 and loaded with bottles, wherein a portion of the carrier is cut away to show the interior of the carrier.
Figure 3:
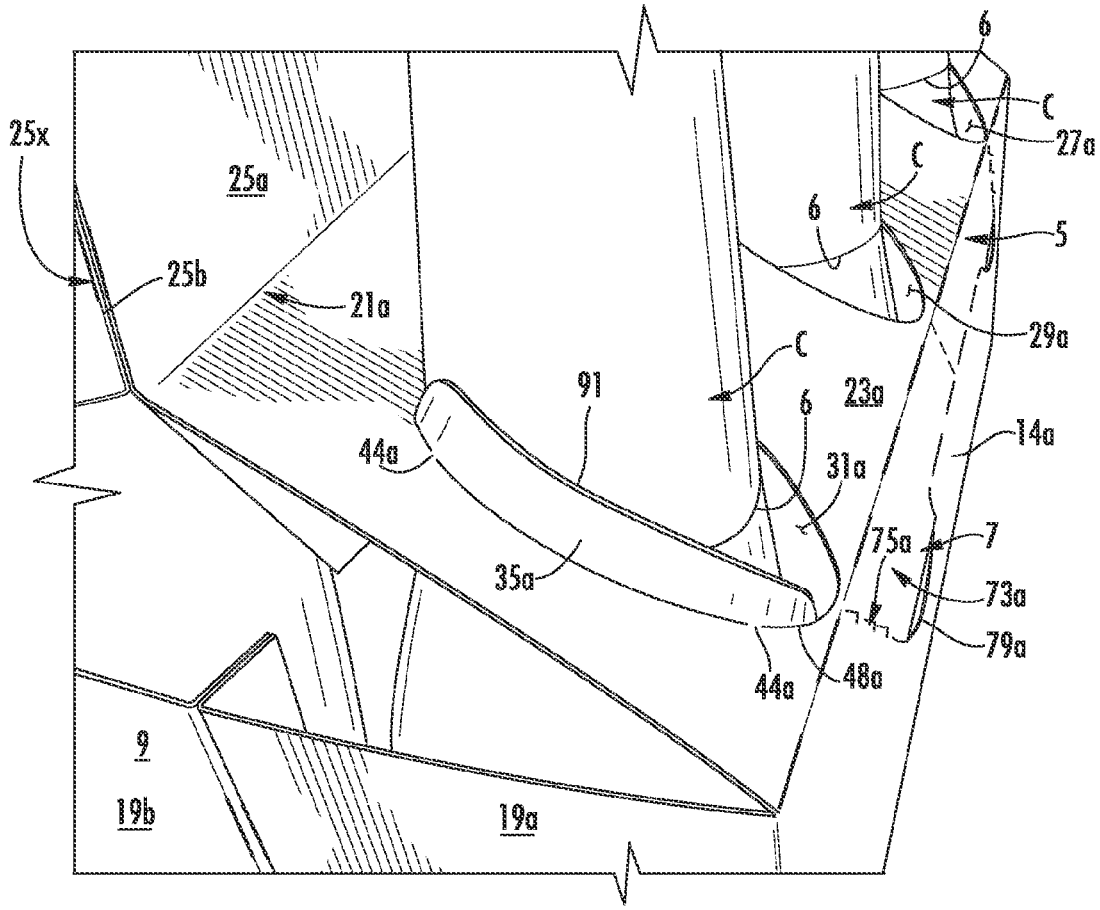
FIG. 3 is a side view of a portion of the loaded, partially cut-away carrier of FIG. 2.
Figure 4:
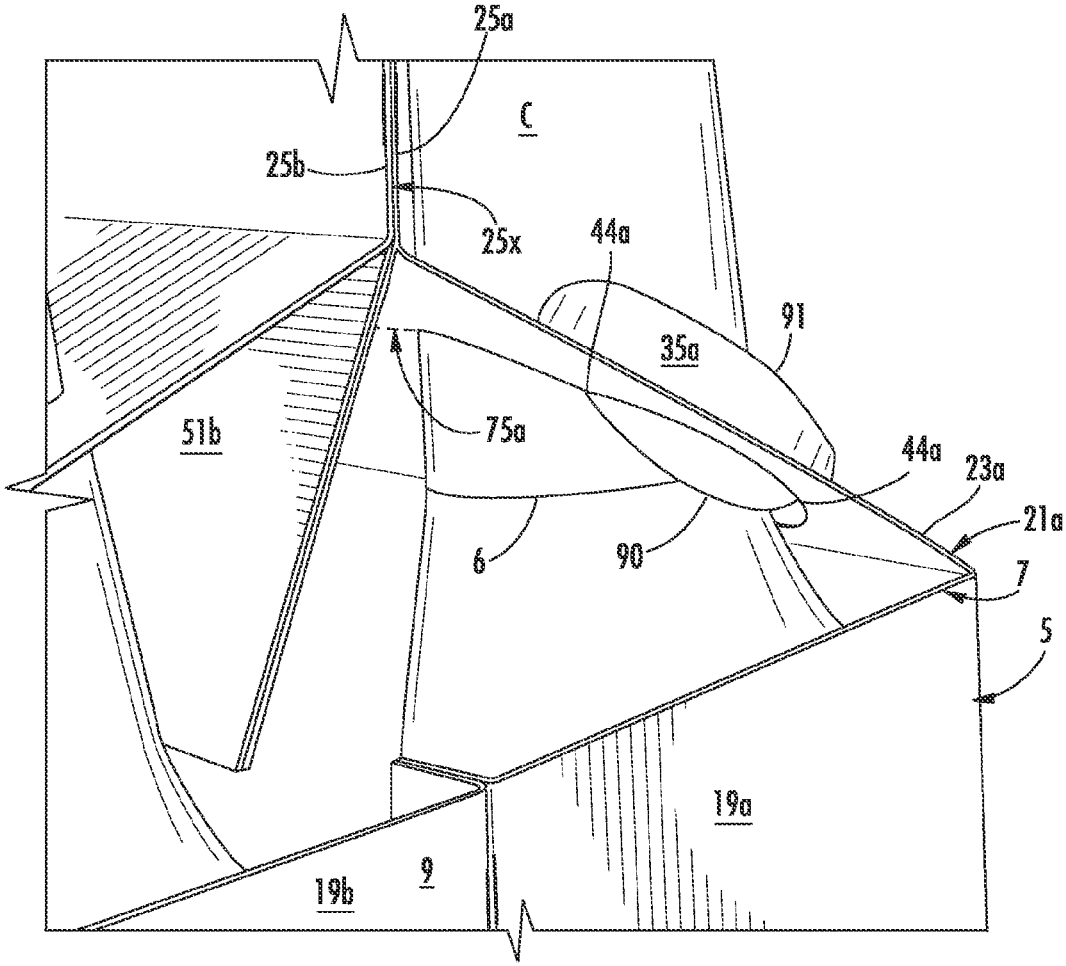
FIG. 4 is a side view of a portion of the loaded, partially cut-away carrier of FIG. 2.

Next, the partially assembled blank 3 is "opened" so that the retention portions 23*a*, 23*b* extend divergently downwardly from the lower end of the handle 25*x*, the side panels 17*a*, 19*a* form the sides of the front portion 7 of the carrier 5, the front panel 14*a* forms the front of the carrier, the side panels 17*b*, 19*b* form the sides of the back portion 9 of the carrier 5, and the back panel 14*b* forms the back of the carrier. The partially assembled blank 3 has an open bottom to allow the partially assembled blank to be placed over the top of a group of containers C. During the relative movement, the containers C are received in respective openings 27*a*, 29*a*, 31*a* at the front portion 7 and respective openings 27*b*, 29*b*, 31*b* at the back portion 9 of the carrier 5. In FIGS. 2-4, upper portions of the side panels 19*a*, 19*a* have been cut away to show a portion of the interior of the carrier 5.

Each container C received in a respective outer opening 27*a*, 31*a*, 27*b*, 31*b* contacts a respective reinforcement flap 33*a*, 35*a*, 33*b*, 35*b* and pivots the respective reinforcement flap in the manner shown for the reinforcement flap 35*a* in FIGS. 2-5. For example, the structure and functionality of the reinforcement flap 35*a* and associated features shown in FIGS. 2-4 is representative of the functionality of the other reinforcement flaps 33*a*, 33*b*, 35*b* and associated features. The nicks 44*a* function as connectors that pivotably connect the reinforcement flap 35*a* to an edge (at least one edge) of the opening 31*a* so that the reinforcement flap 35*a* is pivotable about a pivot axis. The pivot axis is cooperatively defined by the nicks 44*a*, and the pivot axis extends in an axial direction across the opening 31*a*. The nicks 44*a* are spaced apart from one another in the axial direction. The reinforcement flap 35*a* includes opposite inner and outer edges 90, 91 that are spaced apart from one another in a lateral direction that extends crosswise to the axial direction, so that the pivot axis is positioned between the inner and outer edges of the reinforcement flap 35*a*.

As the respective container C moves into the opening 31*a* from below and engages the reinforcement flap 35*a*, the reinforcement flap 35*a* pivots about its pivot axis defined by the nicks 44*a* so that the opposite inner and outer edges 90, 91 of the reinforcement flap 35*a* simultaneously pivot in opposite directions. When the neck of the container C fully extends through the opening 31*a* and is engaged to the reinforcement flap 35*a*, the reinforcement flap 35*a* extends upright (e.g., at a nonzero angle relative to the retention portion 23*a* of the top panel 21*a*) so that the inner edge 90 is substantially below the upper edge 91 as shown in FIG. 4, and the reinforcement flap 35*a* is curved and at least partially conforms to a curvature of the neck of the subject container.

The reinforcement flaps 33*a*, 35*a*, 33*b*, 35*b* protect the optional foil covers 6 on the necks of the containers C and respectively guide the containers when the partially assembled blank (e.g., the blank formed into a sleeve with an open lower end) is lowered onto the containers. Also, the reinforcement flaps 33*a*, 35*a*, 33*b*, 35*b* protect the edge of the openings 27*a*, 31*a*, 27*b*, 31*b* to prevent the carrier from being damaged or torn at the opening. The use of the reinforcement flaps 33*a*, 35*a*, 33*b*, 35*b* seeks to allow the carrier 5 to be made from a material having a reduced thickness (e.g., paperboard having a lower board caliper).

After the containers C are received in respective openings 27*a*, 29*a*, 31*a*, 27*b*, 29*b*, 31*b*, the bottom of the carrier 5 can be closed by overlapping and securing the bottom flaps 15, 17 to one another with any suitable fastening mechanism(s), such as adhesive material. The carrier 5 can be formed and loaded by other suitable positioning and loading steps without departing from the scope of this disclosure.

Figure 5:
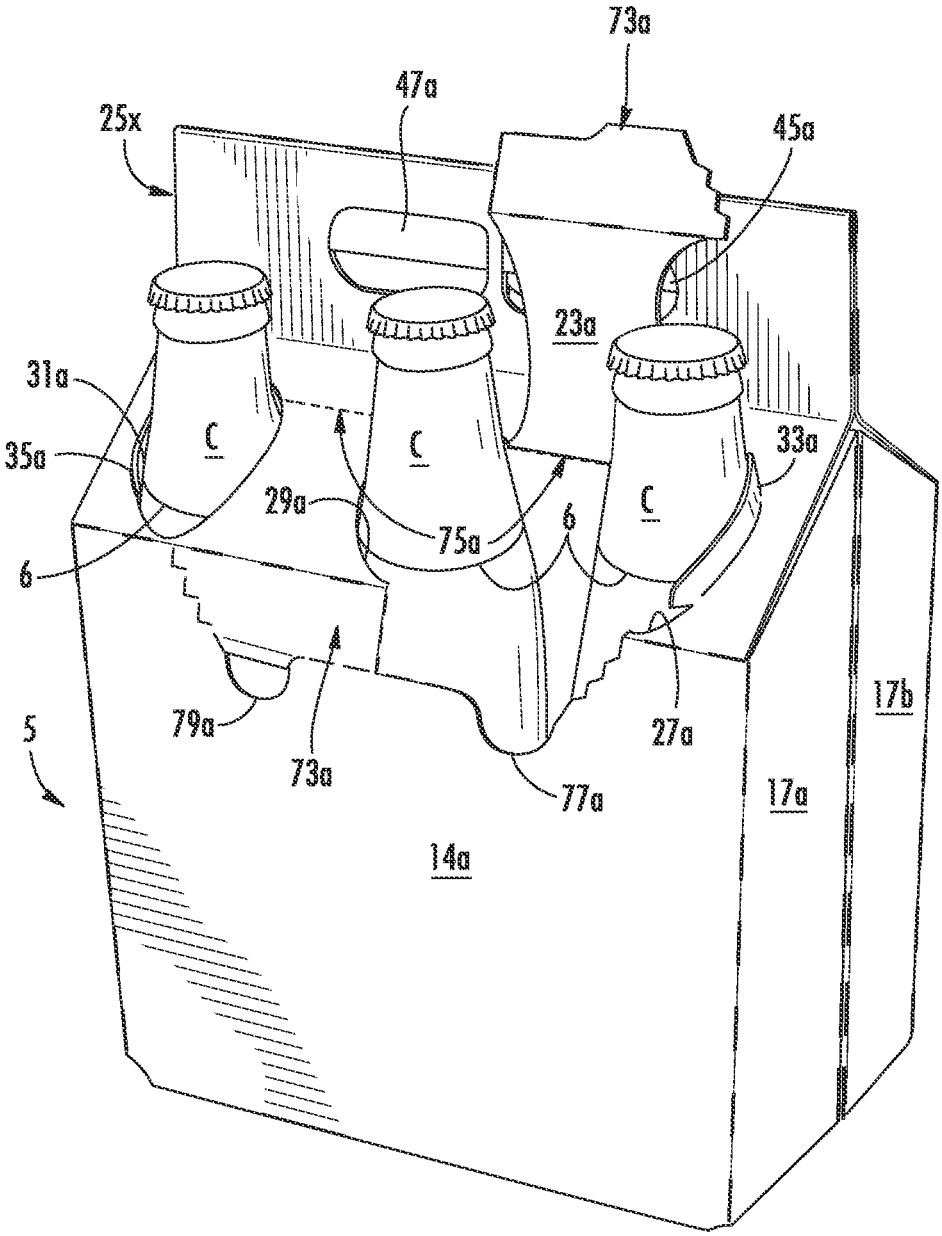
FIG. 5 is a perspective view of the loaded carrier without a portion of the carrier having been cut away, and with a portion of a dispenser panel opened.
Figure 6:
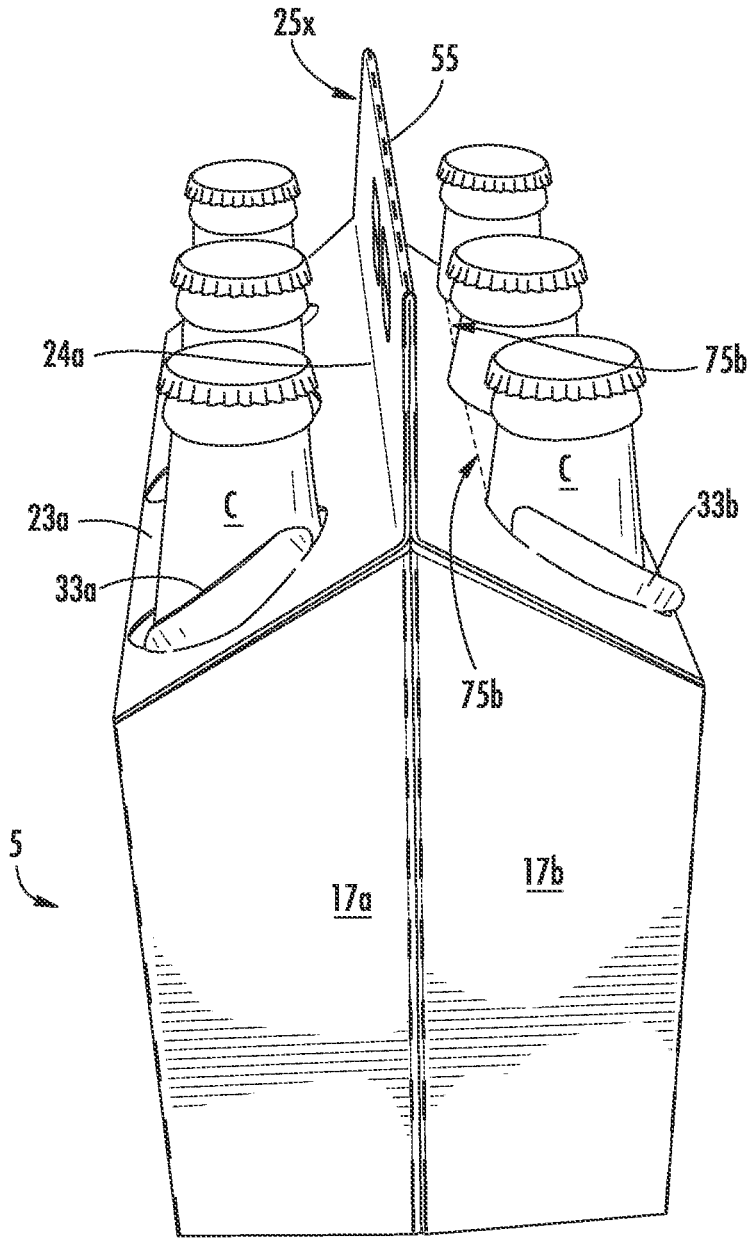
FIG. 6 is a side view of the loaded carrier without a portion of the carrier having been cut away.

After the carrier 5 has been loaded and closed, the containers C can be accessed by tearing a respective dispenser panel 73*a*, 73*b* and creating a dispensing opening (e.g., see FIG. 5). The tabs 77*a*, 79*a*, 77*b*, 79*b* can be used to initiate separation of the dispenser panel 73*a*, 73*b* from a respective front panel 14*a* or back panel 14*b* along a respective tear line 75*a*, 75*b*. The containers C can be accessed and/or removed from the carrier 5 by any other suitable step or other mechanism.

The exemplary carrier embodiment discussed above accommodates six containers arranged in two rows, but the present disclosure is not limited to these numbers. As one example, additional containers may be accommodated by increasing the size of the blank 3 (e.g., in the lateral direction L2 in FIG. 1) and forming additional container-receiving spaces therein. Also, the blank 3 could have less than six container-receiving spaces without departing from the disclosure.

In general, the blank may be constructed from paperboard having a caliper so that it is heavier and more rigid than ordinary paper. The blank can also be constructed of other materials, such as cardboard, or any other material having properties suitable for enabling the carton to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carton embodiments. The term "glue" is intended to encompass all manner of adhesives commonly used to secure carton panels in place.

The above examples are in no way intended to limit the scope of this disclosure. It will be understood by those skilled in the art that while the present disclosure has been discussed above with reference to exemplary embodiment(s), various additions, modifications and changes can be made thereto without departing from the spirit and scope of the invention as set forth in the claims.

What is claimed is:

1. A carton for at least partially receiving a container having a neck, the carton comprising:

a plurality of panels for extending at least partially around an interior of the carton;

a container-receiving opening that is defined in at least one panel of the plurality of panels for receiving the neck, the container-receiving opening having a curved edge in the at least one panel;

a flap foldably connected to the at least one panel at the curved edge of the container-receiving opening, the flap being positionable to cooperate with the curved edge to at least partially form the container-receiving opening;

first and second connections, the flap being pivotably connected to the at least one panel by the first and second connections, the flap is pivotable about a pivot axis, wherein the pivot axis is cooperatively defined by the first and second connections, the pivot axis extends in an axial direction across the container-receiving opening, the first and second connections are spaced apart from one another in the axial direction, and the flap includes opposite first and second edges that are spaced apart from one another in a lateral direction that extends crosswise to the axial direction, the pivot axis is positioned between the first and second edges of the flap;

the first edge of the flap is curved and adjacent the at least one panel and configured to be positioned below the curved edge of the container-receiving opening and the second edge of the flap is substantially straight and defines at least a portion of the container receiving opening, the second edge is configured to be positioned above the curved edge of the container-receiving opening, the neck extending through the container-receiving opening such that a portion of the flap above the curved edge contacts the neck and a portion of the flap below the curved edge contacts the neck, the flap having a surface between the first edge and the second edge, the surface is configured to contact an external surface of the container along the length of the flap, the flap is curved and conforms to the curved edge, the flap extends around a portion of the circumference of the neck and conforms to a curvature of the neck to contact the neck around a portion of the circumference of the neck to protect the neck of the container, the curved edge of the container-receiving opening is free from contact with the neck of the container.

2. The carton according to claim 1, wherein the flap defines a nonzero angle with the at least one panel in which the container-receiving opening is defined.

3. The carton according to claim 1 in combination with the container, wherein:

the container is at least partially positioned in the carton; and the neck extends through the container-receiving opening and is engaged to the flap, the flap is curved and at least partially conforms a curvature of the neck.

4. A method of bringing the carton of claim 1 and the container together, comprising causing relative movement between the carton and the container so that engagement between the container and the flap causes the flap to pivot about the pivot axis from a first configuration, in which the flap is substantially coplanar with the at least one panel in which the container-receiving opening is defined, to a second configuration in which:

the neck extends through the container-receiving opening and is engaged to the flap.

5. A carrier holding a plurality of containers with necks, the carrier comprising:

panels for extending at least partially around an interior of the carrier, wherein the panels comprise at least one top panel, the at least one top panel comprises a handle portion and a retaining portion, the handle portion is foldably connected to the retaining portion, the handle portion at least partially forms a handle of the carrier, and the retaining portion has container-receiving openings for respectively receiving the necks of the containers when the containers are held by the carrier;

a reinforcing flap extending through a container-receiving opening of the container-receiving openings, the container-receiving opening having a a curved edge in the retaining portion for engaging at least one of the necks, the reinforcing flap is foldably connected to the retaining portion at the curved edge of the container-receiving opening and is positionable to cooperate with the curved edge to at least partially form the container-receiving opening, the reinforcing flap comprising opposite inner and outer edges, the inner edge is curved and positioned in the interior of the carton below the curved edge of the container-receiving opening, and the outer edge is substantially straight and positioned outside of the interior of the carton above the curved edge of the container-receiving opening; and first and second connections that are spaced apart from one another around a periphery of the container-receiving opening, the reinforcement flap being foldably connected to the retaining portion by the first and second connections, wherein the neck extends through the container-receiving opening and the flap is positioned with a portion of the flap above the curved edge of the container-receiving opening in contact with the neck and a portion of the flap below the curved edge of the container-receiving opening in contact with the neck, the flap having a surface between the inner edge and the outer edge, the surface is configured to contact an external surface of the container along the length of the flap, the flap is curved and conforms to the curved edge, the flap extends around a portion of the circumference of the neck and conforms to a curvature of the neck to contact the neck around a portion of the circumference of the neck to protect the neck of the container, the curved edge of the container-receiving opening is free from contact with the neck of the container.

6. The carrier of claim 5 wherein the panels further comprise a front panel, a back panel, a first side panel, a second side panel and at least one bottom panel.

7. The carrier of claim 6 wherein the first side panel is foldably connected to at least one of the front panel and back panel.

8. The carrier of claim 6 wherein the second side panel is foldably connected to at least one of the front panel and back panel.

9. The carrier of claim 5 wherein the first and second connections are first and second nicks that comprise material that is free from lines of weakening.

10. The carrier of claim 5 wherein the handle portion is an upper portion of the top panel and the retaining portion is a lower portion of the top panel.

11. The carrier of claim 6 wherein the at least one top panel comprises a first top panel foldably connected to the front panel and a second top panel foldably connected to the back panel.

12. The carrier of claim 5 wherein the reinforcement flap is partially defined by a curved cut in the retaining portion.

13. The carrier of claim 5 wherein a portion of the reinforcement flap protrudes above the retaining portion and a portion of the reinforcement flap protrudes below the retaining portion when the containers are received in the carrier.

14. The carrier according to claim 5, wherein the at least one top panel comprises a first top panel and a second top panel, the first top panel being foldably connected to one of the front panel and the back panel, the second top panel being foldably connected to the other one of the front panel and the back panel, the handle portion comprising a first handle portion in the first top panel and a second handle portion in the second top panel, the retaining portion comprising a first retaining portion in the first top panel and a second retaining portion in the second top panel, and the first top panel being foldably connected along a fold line to the second top panel.

* * * * *